US006817830B1

(12) United States Patent
Chen

(10) Patent No.: US 6,817,830 B1
(45) Date of Patent: Nov. 16, 2004

(54) CEILING FAN WITH MULTIPLE ROTORS

(76) Inventor: Chia-Teh Chen, 5Fl., No. 30, Yi Shian Rd., Sung Shan Chiu, Taipei (TW)

( * ) Notice: Subject to any disclaimer, the term of this patent is extended or adjusted under 35 U.S.C. 154(b) by 33 days.

(21) Appl. No.: 10/455,985

(22) Filed: Jun. 5, 2003

(51) Int. Cl.[7] ..... F01D 1/24
(52) U.S. Cl. ..... 415/60; 415/61
(58) Field of Search ..... 415/61, 62, 60

(56) References Cited

U.S. PATENT DOCUMENTS 3,458,739 A * 7/1969 Zelinski et al. ..... 310/62
5,887,785 A * 3/1999 Yilmaz ..... 237/1 R
6,160,956 A * 12/2000 Pelonis ..... 392/361
6,244,820 B1 * 6/2001 Yilmaz ..... 416/146 R

* cited by examiner

*Primary Examiner*—Hoang Nguyen
(74) *Attorney, Agent, or Firm*—Charles E. Baxley

(57) ABSTRACT

A ceiling fan with multiple rotors, comprising a shaft unit, a rotation seat, a power transmission unit, and a fan mechanism. In operation, each of the two movable fans is both rotated on its own axis and rotated about the shaft unit, while the motor set of the fan mechanism also drives the rotation disk to rotate, thereby rotating the fan blades simultaneously. Thus, the ceiling fan produces a three-dimensional air flow rate with rotation of 360 degrees, thereby efficiently providing a three-dimensional heat dissipation effect.

11 Claims, 5 Drawing Sheets

CEILING FAN WITH MULTIPLE ROTORS

BACKGROUND OF THE INVENTION

1. Field of the Invention

The present invention relates to a ceiling fan with multiple rotors, and more particularly to a ceiling fan with multiple rotors, wherein the ceiling fan produces a three-dimensional air flow rate with rotation of 360 degrees, thereby efficiently providing a three-dimensional heat dissipation effect.

2. Description of the Related Art

A conventional ceiling fan 10 in accordance with the prior art shown in FIG. 1 comprises a shaft 13, a rotation seat 12 rotatably mounted on the shaft 13, and two fans 11 each rotatably mounted on a distal end of the rotation seat 12. Thus, each of the two fans 11 is both rotated on its own axis and rotated about the shaft 13, thereby providing a ventilating effect. However, the air flows produced by the two fans 11 easily interfere with each other, thereby decreasing ventilating effect. In addition, the position located under the conventional ceiling fan 10 has the worst ventilating effect.

SUMMARY OF THE INVENTION

The present invention is to mitigate and/or obviate the disadvantage of the conventional ceiling fan.

The primary objective of the present invention is to provide a ceiling fan with multiple rotors, wherein the ceiling fan produces a three-dimensional air flow rate with rotation of 360 degrees, thereby efficiently providing a three-dimensional heat dissipation effect.

Another objective of the present invention is to provide a ceiling fan with multiple rotors, wherein each of the two movable fans is both rotated on its own axis and rotated about the shaft unit, while the motor set of the fan mechanism also drives the rotation disk to rotate, thereby rotating the fan blades simultaneously.

A further objective of the present invention is to provide a ceiling fan with multiple rotors, wherein the ceiling fan is provided with an illumination lamp for providing an illumination effect.

In accordance with the present invention, there is provided a ceiling fan with multiple rotors, comprising a shaft unit, a rotation seat, and a fan mechanism, wherein:

- the shaft unit includes a shaft having a first end provided with a connecting seat and a second end provided with a shade, and a rotation shaft connected to the second end of the shaft;
- the rotation seat is rotatably mounted on the rotation shaft of the shaft unit, and has a center formed with a shaft hole for passage of the rotation shaft of the shaft unit, the rotation seat has a periphery provided with two radially opposite connecting rods each having a distal end provided with a movable fan;
- the fan mechanism is mounted on the rotation seat and includes a motor set mounted on a bottom of the rotation seat, the motor set has a center provided with a propeller shaft rotatably mounted in the shaft hole of the rotation seat; and
- the fan mechanism further includes a rotation disk mounted on a bottom of the motor set to rotate with the propeller shaft of the motor set, the rotation disk has a periphery provided with a plurality of fan blades.

Further benefits and advantages of the present invention will become apparent after a careful reading of the detailed description with appropriate reference to the accompanying drawings.

DETAILED DESCRIPTION OF THE INVENTION

Figure 1:
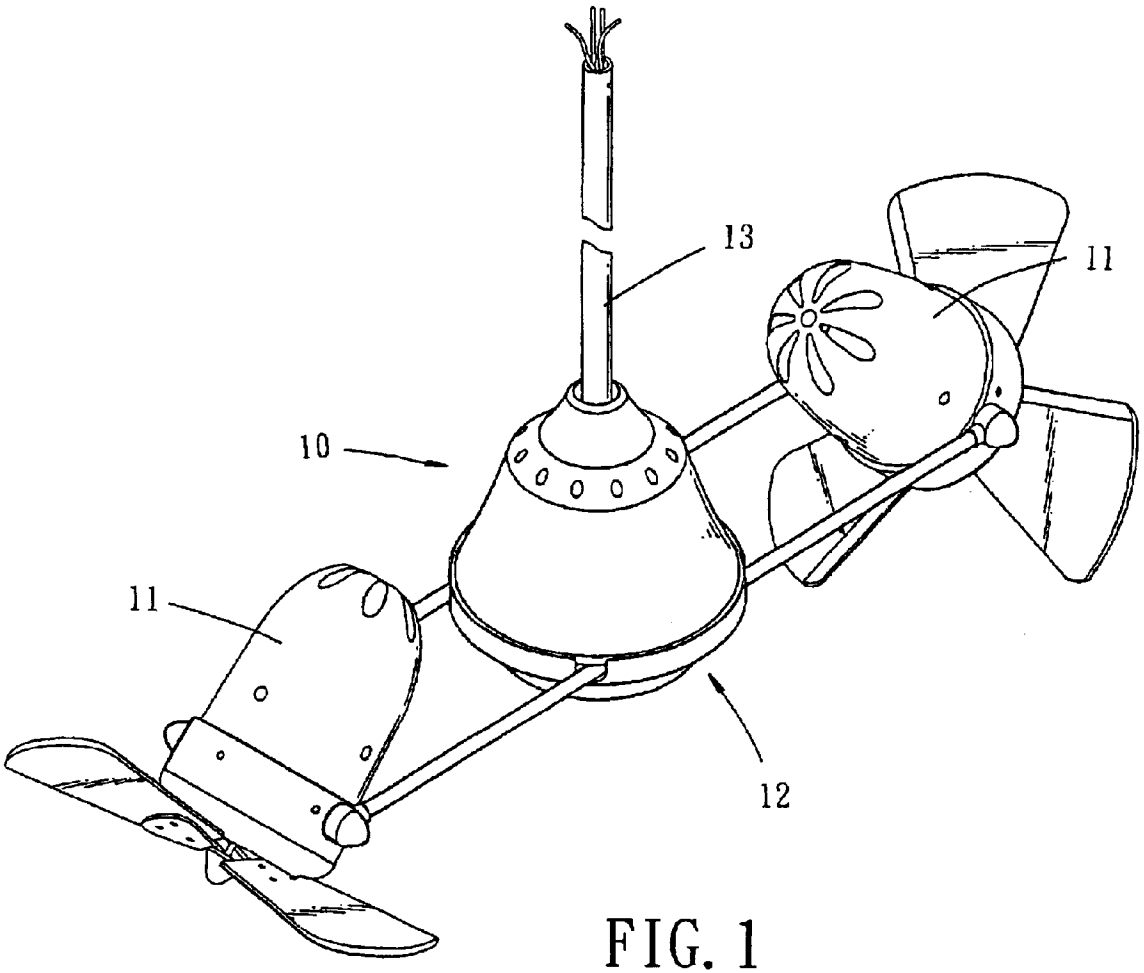
FIG. 1 PRIOR ART
FIG. 1 is a perspective view of a conventional ceiling fan in accordance with the prior art.
Figure 2:
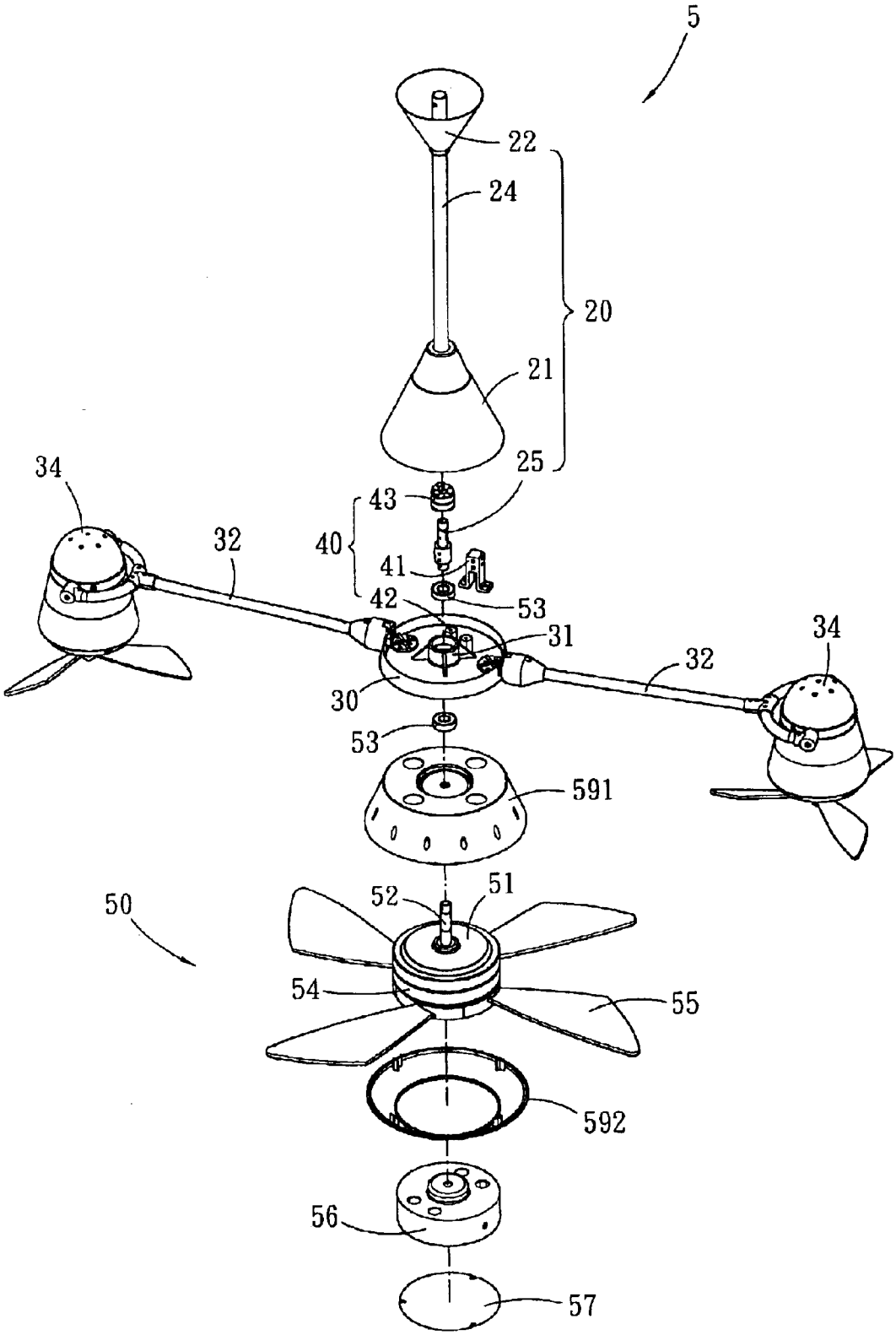
FIG. 2 is an exploded perspective view of a ceiling fan with multiple rotors in accordance with the preferred embodiment of the present invention.
Figure 3:
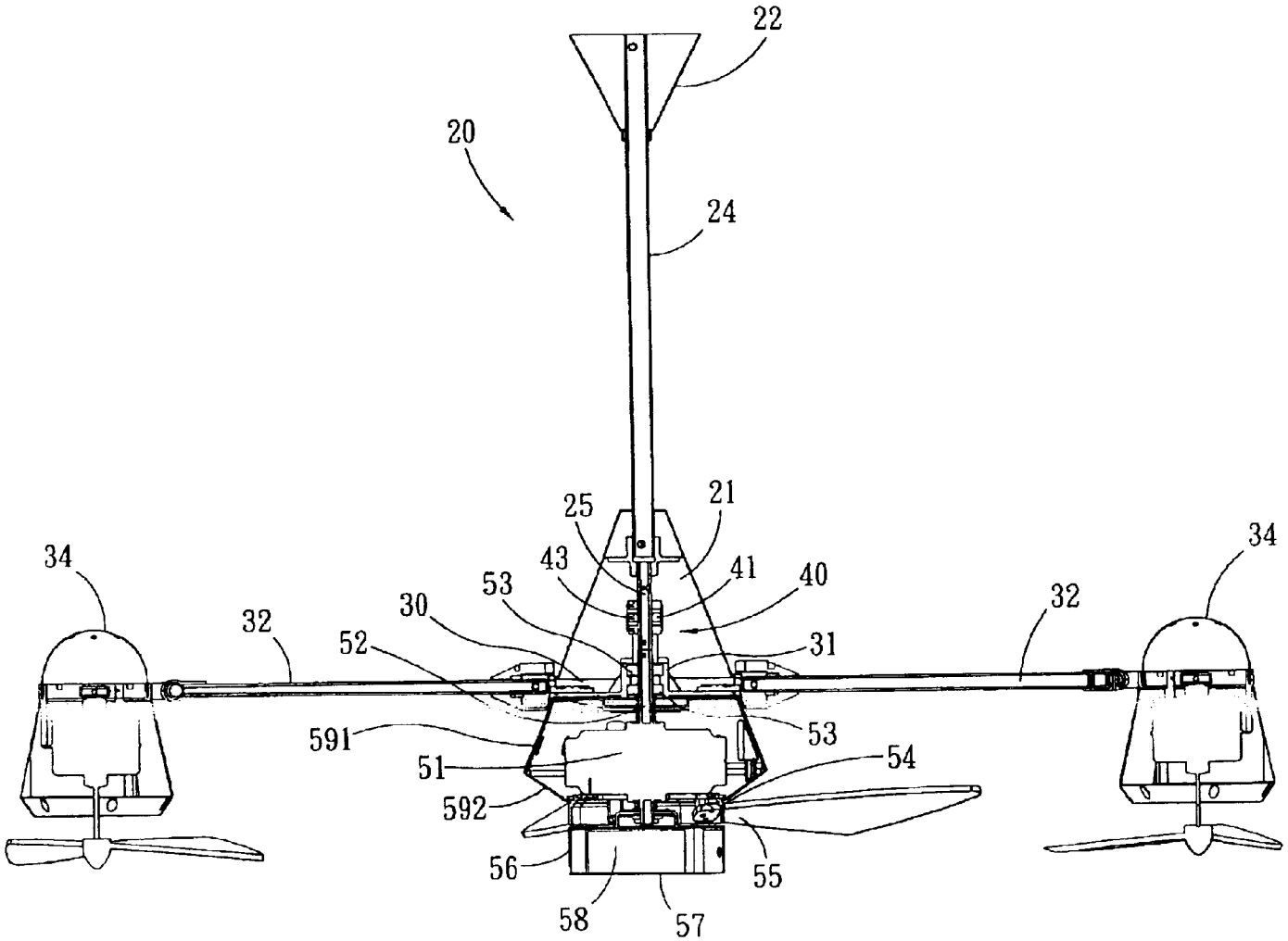
FIG. 3 is a front plan cross-sectional assembly view of the ceiling fan with multiple rotors as shown in FIG. 2.
Figure 4:
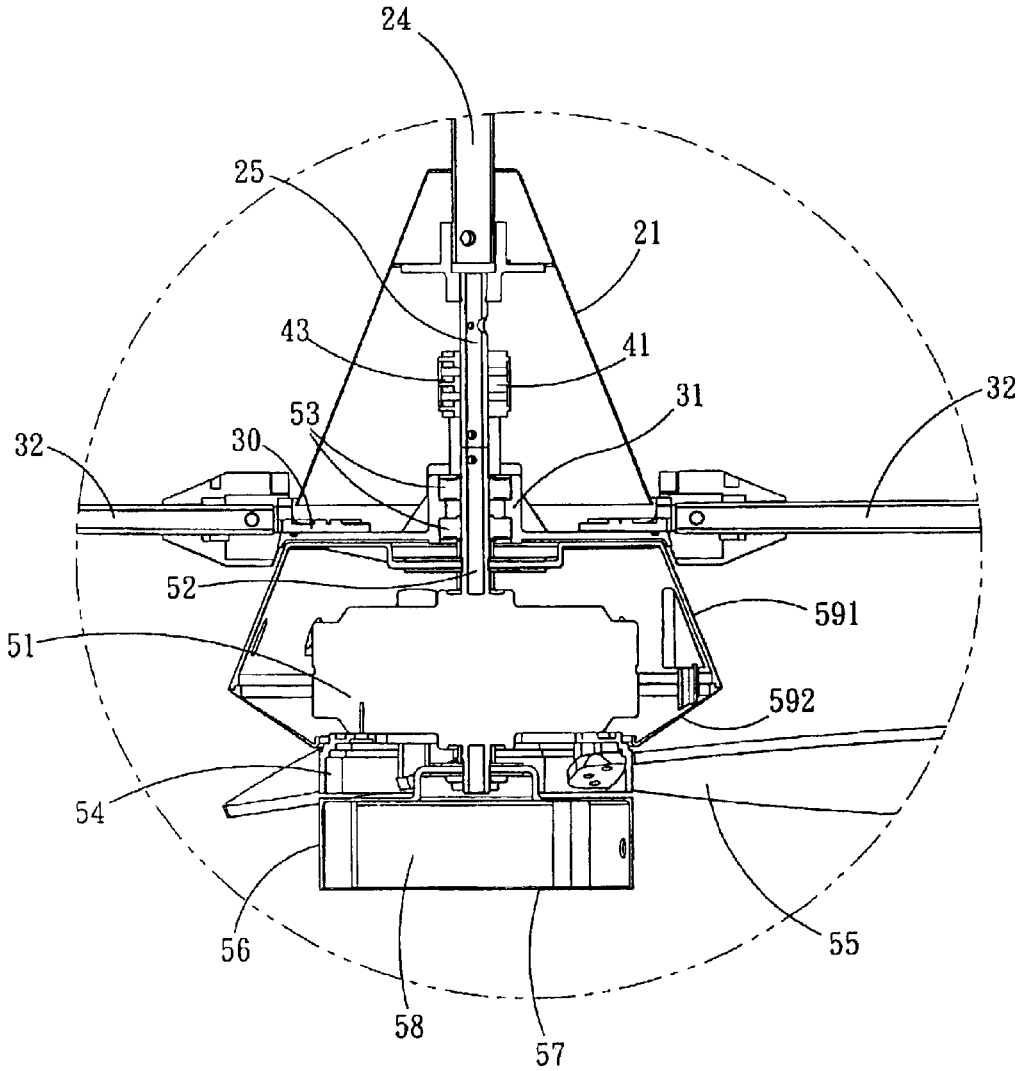
FIG. 4 is a partially enlarged view of the ceiling fan with multiple rotors as shown in FIG. 3.

Referring to the drawings and initially to FIGS. 2–4, a ceiling fan 5 with multiple rotors in accordance with the preferred embodiment of the present invention comprises a shaft unit 20, a rotation seat 30, a power transmission unit 40, and a fan mechanism 50.

The shaft unit 20 includes a shaft 24 having a first end provided with a connecting seat 22 for mounting the shaft unit 20 to the ceiling and a second end provided with a shade 21. The shaft unit 20 further includes a rotation shaft 25 connected to the second end of the shaft 24 and covered by the shade 21.

The rotation seat 30 is rotatably mounted on the rotation shaft 25 of the shaft unit 20, and has a center formed with a shaft hole 31 for passage of the rotation shaft 25 of the shaft unit 20. The rotation seat 30 has a top covered by the shade 21 of the shaft unit 20. The rotation seat 30 has a periphery provided with two radially opposite connecting rods 32 each having a distal end provided with a movable fan 34.

The power transmission unit 40 is mounted on the rotation seat 30 and is covered by the shade 21 of the shaft unit 20. The power transmission unit 40 includes a brush seat 41, a conductive sleeve 43, and a brush conductor 42. The brush seat 41 is secured on the rotation seat 30. The conductive sleeve 43 is mounted on the rotation shaft 25 of the shaft unit 20. The brush conductor 42 is mounted on the rotation seat 30, and is in contact with the conductive sleeve 43.

The fan mechanism 50 is mounted on the rotation seat 30 and includes a motor set 51 mounted on a bottom of the rotation seat 30. The motor set 51 has a center provided with a propeller shaft 52 rotatably mounted in the shaft hole 31 of the rotation seat 30 by two bearings 53. The propeller shaft 52 of the motor set 51 is connected to the rotation shaft 25 of the shaft unit 20. Thus, the rotation seat 30 and the propeller shaft 52 of the motor set 51 are stably rotated simultaneously.

The fan mechanism 50 further includes a rotation disk 54 mounted on a bottom of the motor set 51 to rotate with the propeller shaft 52 of the motor set 51. The rotation disk 54 has a periphery provided with a plurality of fan blades 55.

The fan mechanism 50 further includes an upper housing 591 mounted between the rotation seat 30 and the motor set 51, and a lower housing mounted on the periphery of the lower portion of the motor set 51.

The fan mechanism 50 further includes a lamp seat 56 mounted on the lower end of the rotation disk 54, and a lamp shade 57 mounted on the bottom of the lamp seat 56.

The fan mechanism 50 further includes a control unit 58 mounted in the lamp seat 56 to control the switch of illumination of the lamp seat 56 and the operation states of the ceiling fan 5. The control unit 58 receives a control signal emitted from a remote emitter (not shown) to control the switch of illumination of the lamp seat 56 and the operation states of the fan mechanism 50 and the two movable fans 34, so as to change the multi-stage rotation speeds of the fan mechanism 50 and the two movable fans 34.

Figure 5:
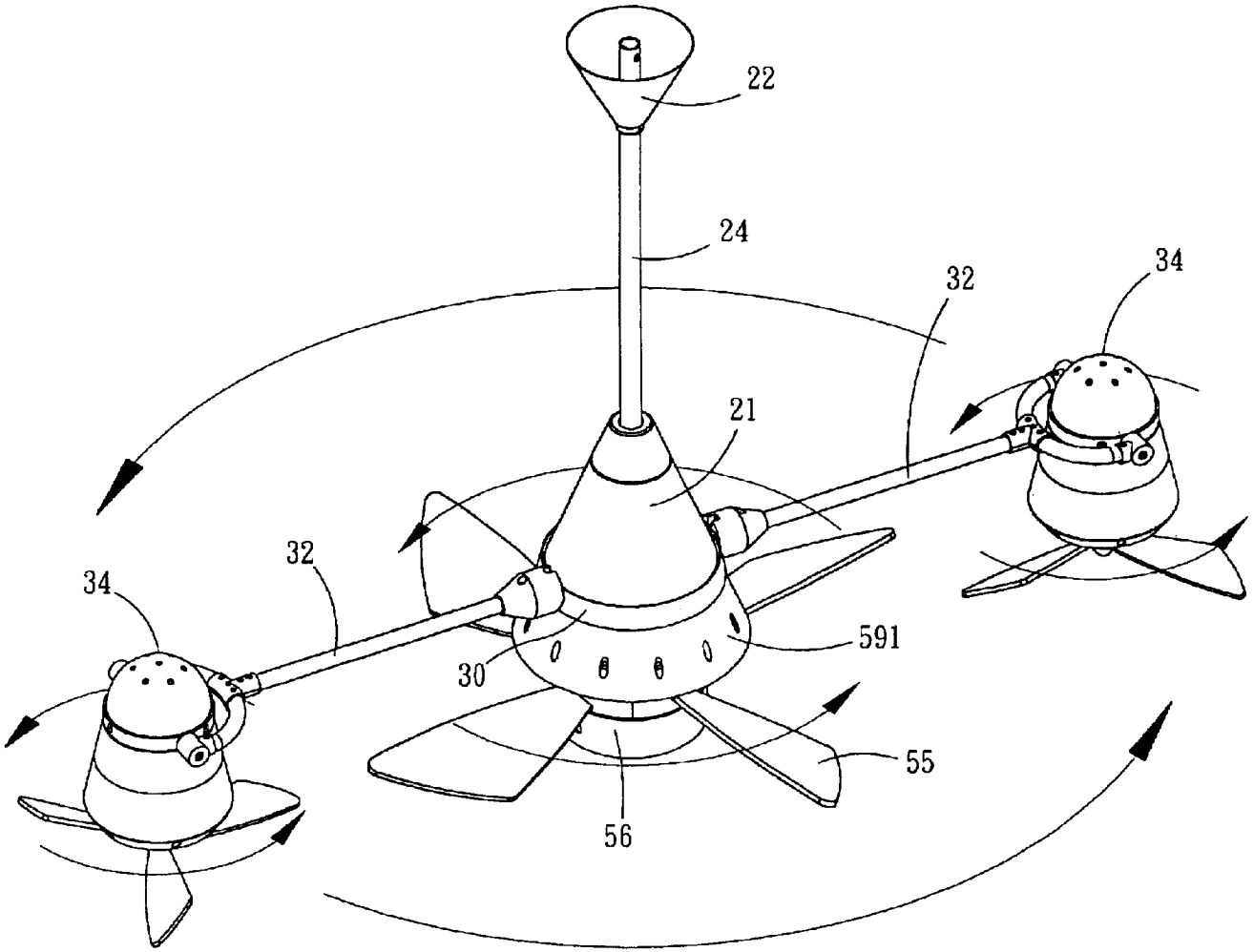
FIG. 5 is a perspective assembly view of the ceiling fan with multiple rotors in accordance with the preferred embodiment of the present invention.

Referring to FIG. 5 with reference to FIGS. 1–4, when the ceiling fan 5 is operated, the rotation seat 30 is rotated so as to rotate the two movable fans 34. In such a manner, each of the two movable fans 34 is both rotated on its own axis and rotated about the shaft unit 20. At the same time, the motor set 51 of the fan mechanism 50 also drives the rotation disk 54 to rotate, thereby rotating the fan blades 55.

Accordingly, the ceiling fan 5 produces a three-dimensional air flow rate with rotation of 360 degrees, thereby providing a three-dimensional heat dissipation effect.

While the preferred embodiment(s) of the present invention has been shown and described, it will be apparent to those skilled in the art that various modifications may be made in the embodiment(s) without departing from the spirit of the present invention. Such modifications are all within the scope of the present invention.

What is claimed is:

1. A ceiling fan with multiple rotors, comprising a shaft unit, a rotation seat, and a fan mechanism, wherein:

the shaft unit includes a shaft having a first end provided with a connecting seat and a second end provided with a shade, and a rotation shaft connected to the second end of the shaft;

the rotation seat is rotatably mounted on the rotation shaft of the shaft unit, and has a center formed with a shaft hole for passage of the rotation shaft of the shaft unit, the rotation seat has a periphery provided with two radially opposite connecting rods each having a distal end provided with a movable fan;

the fan mechanism is mounted on the rotation seat and includes a motor set mounted on a bottom of the rotation seat, the motor set has a center provided with a propeller shaft rotatably mounted in the shaft hole of the rotation seat; and the fan mechanism further includes a rotation disk mounted on a bottom of the motor set to rotate with the propeller shaft of the motor set, the rotation disk has a periphery provided with a plurality of fan blades.

2. The ceiling fan with multiple rotors in accordance with claim 1, wherein the rotation shaft of the shaft unit is covered by the shade.

3. The ceiling fan with multiple rotors in accordance with claim 1, wherein the rotation seat has a top covered by the shade of the shaft unit.

4. The ceiling fan with multiple rotors in accordance with claim 1, wherein the propeller shaft of the motor set is rotatably mounted in the shaft hole of the rotation seat by two bearings.

5. The ceiling fan with multiple rotors in accordance with claim 1, wherein the propeller shaft of the motor set is connected to the rotation shaft of the shaft unit.

6. The ceiling fan with multiple rotors in accordance with claim 1, wherein the fan mechanism further includes an upper housing mounted between the rotation seat and the motor set, and a lower housing mounted on the periphery of the lower portion of the motor set.

7. The ceiling fan with multiple rotors in accordance with claim 1, wherein the fan mechanism further includes a lamp seat mounted on the lower end of the rotation disk, and a lamp shade mounted on the bottom of the lamp seat.

8. The ceiling fan with multiple rotors in accordance with claim 1, wherein the fan mechanism further includes a control unit mounted in the lamp seat.

9. The ceiling fan with multiple rotors in accordance with claim 1, further comprising a power transmission unit mounted on the rotation seat.

10. The ceiling fan with multiple rotors in accordance with claim 9, wherein the power transmission unit includes a brush seat, a conductive sleeve, and a brush conductor, wherein the brush seat is secured on the rotation seat, the conductive sleeve is mounted on the rotation shaft of the shaft unit, and the brush conductor is mounted on the rotation seat and is in contact with the conductive sleeve.

11. The ceiling fan with multiple rotors in accordance with claim 9, wherein the power transmission unit is covered by the shade of the shaft unit.

* * * * *